US006691545B1

(12) United States Patent
Aagaard

(10) Patent No.: US 6,691,545 B1
(45) Date of Patent: Feb. 17, 2004

(54) TOOL AND A METHOD FOR PRESSURE SHAPING

(75) Inventor: Erik Aagaard, Hørning (DK)

(73) Assignee: Hydraulico A/S, Odder (DK)

( * ) Notice: Subject to any disclaimer, the term of this patent is extended or adjusted under 35 U.S.C. 154(b) by 0 days.

(21) Appl. No.: 10/018,481

(22) PCT Filed: Jun. 19, 2000

(86) PCT No.: PCT/DK00/00326

§ 371 (c)(1),
(2), (4) Date: Dec. 19, 2001

(87) PCT Pub. No.: WO00/78477

PCT Pub. Date: Dec. 28, 2000

(30) Foreign Application Priority Data

Jun. 21, 1999 (DK) ..... 1999 00879

(51) Int. Cl.[7] ..... B21D 22/22
(52) U.S. Cl. ..... 72/351; 72/350; 72/347
(58) Field of Search ..... 72/350, 351, 347, 72/348, 349

(56) References Cited

U.S. PATENT DOCUMENTS

| | | | | |
|---|---|---|---|---|
| 1,970,134 A | * | 8/1934 | Ferris | 72/358 |
| 3,420,089 A | * | 1/1969 | Myers | 72/351 |
| 4,195,510 A | * | 4/1980 | Juergens | 72/350 |
| 4,316,379 A | | 2/1982 | Anderson | |
| 4,745,792 A | | 5/1988 | Story et al. | |
| 5,477,723 A | | 12/1995 | Kergen | |

FOREIGN PATENT DOCUMENTS

| | | |
|---|---|---|
| DE | 3724382 | 2/1989 |
| DE | 4343336 | 6/1995 |
| DE | 19528558 | 2/1997 |
| DE | 19610367 | 4/1997 |
| DE | 19541721 | 5/1997 |
| DE | 19607257 | 8/1997 |
| DE | 4435070 | 4/1998 |
| EP | 531 141 | 3/1995 |
| EP | 613 740 | 9/1997 |
| EP | 835 699 | 4/1998 |
| WO | WO97/46337 | 12/1997 |

* cited by examiner

*Primary Examiner*—Allen Ostrager
*Assistant Examiner*—John S Goetz
(74) *Attorney, Agent, or Firm*—James Creighton Wray; Meera P. Narasimhan

(57) ABSTRACT

The invention concerns a tool for regulating the surface pressure on a blank constituting a metal plate which forms the starting item for shaping a finished item in a press. The blank is placed between a draw ring (23) and a blank holder ring (24). Besides, the tool comprises a shimming plate (1, 5, 10) provided with chambers (2, 3, 4, 6, 7, 8, 9, 11, 12, 13, 14) which are delimited by the shimming plate itself and by a flexible membrane (27). The shimming plate is placed between a tool bottom part (17), alternatively a tool top part (16), and the blank holder ring, alternatively the draw ring. A pressure medium like hydraulic oil may be led to the chambers. Thereby it is possible locally and individually to increase the surface pressure on the blank depending on the number of chambers, the design of chambers and the location of the chambers in the shimming plate. Furthermore, it is possible to regulate the pressure during the shaping process itself.

10 Claims, 3 Drawing Sheets

TOOL AND A METHOD FOR PRESSURE SHAPING

BACKGROUND OF THE INVENTION

The present invention concerns a tool for pressure shaping of metal plate and intended for use in a conventional hydraulic or mechanical press with at least one die, the tool comprising a shimming plate to be disposed between a tool part and further pressing tools, where the shimming plate is provided with at least one chamber formed in the shimming plate at at least one side as seen in the direction of pressing and which inwards is delimited by the shimming plate and outwards is delimited by a flexible membrane fastened to an edge area of the chamber, which least one chamber is provided along a given length outward from the die and extending outward from and around this, and where in the shimming plate there is formed access to the chamber for a fluid for creating a pressure in the chamber, and where the metal plate to be shaped is intended to be placed between the further pressing tools, alternatively between one of the further pressing tools and the shimming plate.

U.S. Pat. No. 3,420,089 describes a way of individually regulating the pressure between draw rings and a blank. A tool comprises a number of annular chambers each extending all the way around a die and which are mutually separated in direction away from the die. Each of the annular chambers is provided with inlets for hydraulic oil, and the pressure from the hydraulic oil may be regulated individually for each of the chambers. The tool is intended to create a uniform, though individual, pressure everywhere around the periphery of the die within each the chambers. Thereby the surface pressure can be regulated so that it is least at the outermost part of the periphery and increases in direction inwards toward the innermost part of the periphery around the die.

This tool, however, implies some disadvantages. The tool is suitable for radially symmetrical work pieces. For work pieces that are not radially symmetrical, it will not be possible to use the work piece and achieve a satisfactory result as there is no possibility of adjusting the surface pressure along the periphery with respect to the parameters influencing the finished item.

Furthermore, abrupt and relatively large jumps in the pressure distribution as seen in radial direction will occur on the blank to be shaped when an outer rim of the blank is drawn from the outer periphery and radially inward from one annular chamber to the other annular chamber. This may influence the shaping process itself and may result in uneven and sudden displacement of the die and consequently unsatisfactory shaping with the risk of great variations in the thickness of the finished item or, in the worst case, with the risk of breakage in the finished item.

EP 835 699 describes another way of regulating the pressure individually between blank holder rings and blank. The tool comprises a tool base plate provided with a number of holes which constitute guides for a number of lesser press mandrels. A multiple point pressure plate comprises a corresponding number of lesser hydraulic press pistons which are capable of acting on each single press mandrel extending through the guides in the tool base plate. By shaping the press mandrels individually and by acting individually on press mandrels by the lesser press pistons it is possible to regulate the pressure and the press surface individually at different places on the blank.

This tool implies a greater possibility of regulating the surface pressure also for blanks not being radially symmetrical. However, achieving the desired pressure at a given place on the blank is connected with extensive replacement of press mandrels and regulation of the pressure for each of the press mandrels. Furthermore, the tool implies the limitation that the position of the press pistons is determined by the multiple point pressure plate, and the shape of the press mandrels is limited by certain simple geometries. This means that it is not possible to achieve a completely optimal, individual adjusting of the pressure depending of the work piece to be shaped and depending on the shape of the blank.

SUMMARY OF THE INVENTION

It is the purpose of the present invention to provide a tool for press where it is possible to individually regulate the surface pressure at any place on the blank and over any area extending laterally around the die and away from the die under consideration of the parameters having influence on the finished item, so that the surface pressure on the blank becomes optimal with respect to the blank, the finished item and the shaping process itself.

This purpose is achieved with a tool which is peculiar in that a division into several chambers has been made in direction around the die, and that the chambers are formed by millings in the shimming plate, that a membrane is fastened to the edge of the milling in such way that the upper side of the membrane lies in the same plane as the surface of the shimming plate, that the milling has a depth, and that the membrane has a thickness less than or equal to the depth of the milling.

Provided chambers are formed with individually adjusted shape both in direction around the die and in direction away from the die, and where the number of chambers as seen in direction away from the die may be chosen individually, there is possibility of performing complete adjustment of the surface pressure on the blank under consideration of the different parameters having influence on the finished item. Furthermore, the shape of the chambers with the membrane placed in the milling will cause the upper side of the membrane to lie in the same plane as the surface of the shimming plate and make possible adjustment of the blank holder pressure as the membrane by pressurisation of the chambers is displaced out of contact with the bottom of the milling. Thus, in principle, a largely perfect item can be attained as the different parameters are completely adjusted to the blank concerned. In the remaining part of the present description, the term blank is used as designation for the metal plate constituting the starting item without limitation to the possible dimensions of a metal plate to be shaped by the tool and by the method according to the invention.

Adjustment takes place both statically and dynamically. The static adjustment is performed by the selected shapes and positions of the chambers around the die, and the dynamic adjustment takes place by regulating the pressure in the chambers during the shaping process itself. The static adjustment may be performed based on empirical data for the material and dimensions of the blank, for the lubrication used during the shaping process, and for the geometry and dimensions of the finished item. The dynamic adjustment may be performed based on running data about the pressing force and the pressing speed from the press used and data concerning the current pressure in each chamber in the shimming plate.

The chambers may be formed by real millings in the tool made in the shimming plate in order to form the chambers in the shimming plate and under the membrane when the membrane is attached to the shimming plate. At the location of the chambers it is hereby possible both to increase and to reduce the pressure between the shimming plate and the blank holder ring, alternatively the draw ring, and thereby to increase or to lessen the pressure on the metal plate to be shaped. When a volume of pressure medium completely corresponding to the volume of the chamber is supplied when the membrane is in the neutral state, i.e. in completely plane state, then the pressure will be the same as the pressure over the rest of the metal plate between the blank holder ring and the draw ring where the membrane contacts the blank holder ring, alternatively the draw ring.

The pressure is increased as compared with the pressure between the draw ring and the blank holder ring by the chamber being supplied a greater volume of pressure medium than the volume of the chamber which is delimited by bottom and sides of the milling and by the under side of the membrane in neutral state. The pressure is reduced as compared with the pressure between the draw ring and the blank holder ring by the chamber being supplied a lesser volume of pressure medium than the volume of the chamber which is delimited by bottom and sides of the milling and by the under side of the membrane in neutral state.

A method according to the invention is peculiar in that in a first step there is established a first pressure in a first zone between a draw ring and a blank holder ring and a second pressure in a number of chambers in a second zone, and that in a second, subsequent step there is established at least a second first pressure in the chambers in the first zone and optionally a second second pressure in the chambers in the second zone.

Such a method ensures that the dynamic adjusting of the surface pressure on the blank is optimal all the time in order hereby to reduce or to completely eliminate the risk of defects in the finished item. A current supervision of the pressure in each zone implies that it is possible immediately to adjust the pressure in one or more of the zones for obtaining a desired surface pressure on the blank during different steps of the shaping process and/or to compensate for irregularities during the shaping process.

The invention will then be described in more detail with reference to the accompanying drawing, where:

DETAILED DESCRIPTION OF THE PREFERRED EMBODIMENTS

Figure 1:
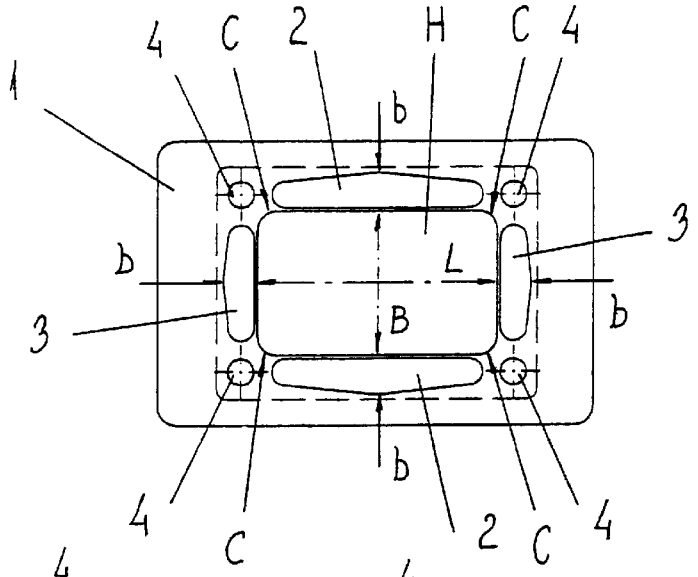
FIG. 1 is plane view from above of first embodiment of a shimming plate for shaping an item with a first shape.

FIG. 1 shows a so-called shimming plate 1 that constitutes a part of a tool for, in the embodiment shown, shaping a single kitchen sink. The sink itself has length L, width B and rounded corners C. This shape is formed as an aperture H through the shimming plate. Around the aperture H forming the shape of the sink, chambers 2,3,4 are formed by making indentations in the shimming plate. In the shown embodiment, around the aperture H forming the shape of the sink, there are formed two longitudinal chambers 2, two transverse chambers 3 and four chambers 4 opposite to the corners C. The longitudinal chambers 2 and the transverse chambers 3 are oblong with a width b slightly greater at the centre of the chamber 2,3 than at the ends of the chambers 2,3. Furthermore, the chambers 2,3 are rounded at the ends. The chambers 4 at the corners C of the aperture H are circular.

Figure 2:
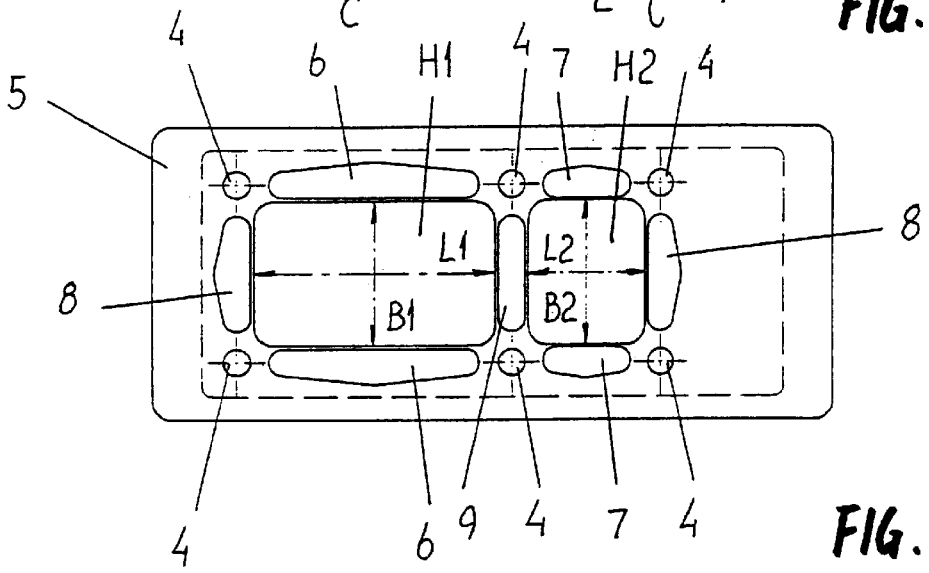
FIG. 2 is a plane view from above of a second embodiment of a shimming plate for shaping an item with a second shape.

FIG. 2 is a so-called shimming plate 5 constituting a part of a tool for, in the embodiment shown, shaping a double kitchen sink. The kitchen sink itself has a first sink with a length L1 and a width B1 and second sink with a length L2 and width B2. This shape is formed as a first aperture H1 and a second aperture H2 through the shimming plate 5. Around each of the apertures H1,H2 together forming the shape of the two sinks there are also formed longitudinal chambers 6,7 and transverse chambers 8 together with chambers 4 at the corners C of the apertures H1,H2. A transverse chamber 9 formed between the first aperture H1 and the second aperture H2 is common to the two apertures. The chamber 9 is oblong with the same width along the chamber and with rounded ends of the chamber. The other longitudinal and transverse chambers 6,7,8 are oblong with a width b at the centre of the chamber being slightly larger than at the ends of the chambers, and the ends of the chambers 6,7,8 are rounded. The chambers 4 at the corners C of the apertures H1,H2 are circular.

Figure 3:
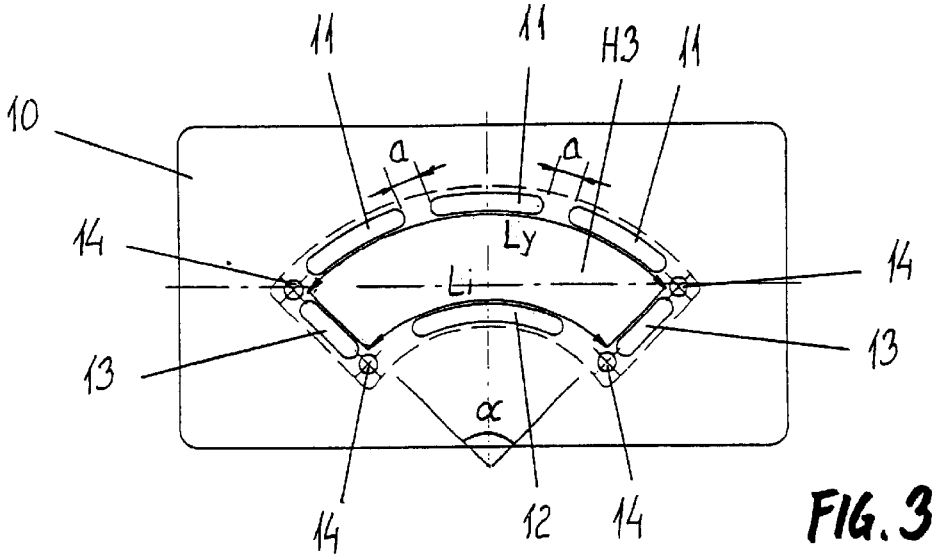
FIG. 3 is a plane view from above of a third embodiment of a shimming plate for shaping an item with a third shape.

FIG. 3 shows a shimming plate 10 constituting a part of a tool for, in the embodiment shown, shaping one diametrical half of a pipe bend. The pipe bend is formed in an aperture H3 in the shimming plate. The aperture H3 has shape as a part of a ring. The aperture extends over an angle $\alpha$. The aperture has external length Ly and internal length Li. Three chambers 11 are formed along the outer length Ly, the chambers 11 each being oblong and extending along an arc corresponding to the aperture H3. The chambers 11 are rounded at the ends. The chambers 11 are formed with mutual distance a between the ends of the chambers 11. Along the inner length Li there is formed a single chamber 12 also being oblong and also extending along an arc corresponding to the aperture H3. Along transverse sides of the aperture, transverse chambers 13 are formed, also rounded at the ends. By the corners C of the aperture H3 circular chambers 14 are formed.

Figure 4:
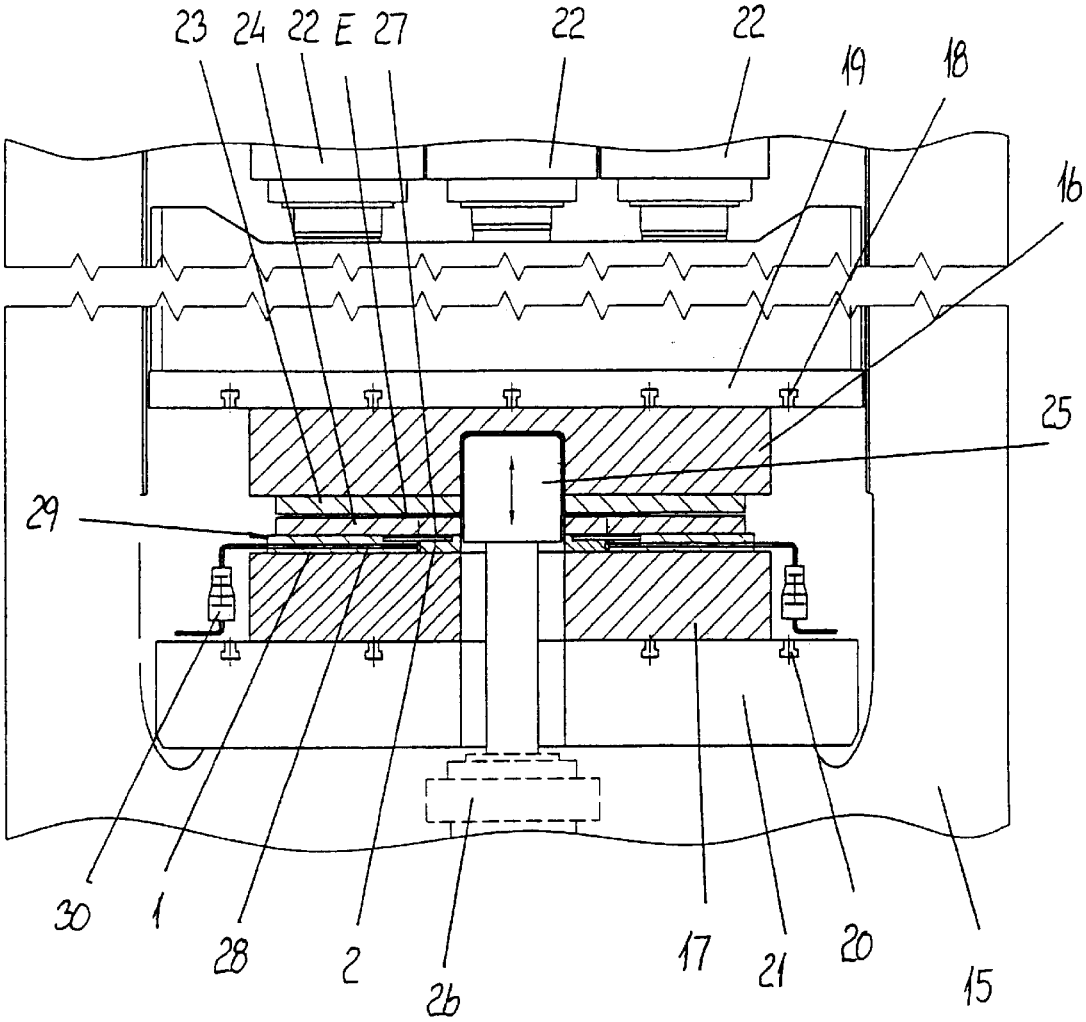
FIG. 4 is a section through a possible embodiment of the whole tool according to the invention.

For the shown embodiments of shimming plates for tools according to the invention appliy that the aperture for forming the item is intended for forming a through hole for a die in a press (see FIG. 4). The chambers extend laterally around the die, and the chambers extend away from the die. However, the chambers may only extend over a given length around the die, depending on the blank in question, and the chambers will not extend all the way around the die. This is to achieve the possibility of individual regulation of a given surface pressure on the blank constituting the starting item at given positions laterally around and away from the die.

In the embodiments shown for shimming plates, there is only a single chamber in direction away from the aperture which the die is to be displaced through. In alternative embodiments for other items than shown, there may be two or more chambers in direction away from the aperture for allowing the possibility of achieving a further individual regulation of the blank holding pressure on the blank during shaping.

FIG. 4 is a section through a tool according to the invention. The tool is mounted in a press 15 between a tool top part 16 and a tool bottom part 17. The tool top part 16 is mounted in groove 18 in a thrust plane 19, and the tool bottom part 17 is mounted in groove 20 in a press fixing plane 21. The press fixing plane 21 is fixed in relation to the press frame. By means of hydraulic cylinders 22 the thrust plane 19 may be displaced upward and downward in relation to the press fixing plane 21.

A blank E for making e.g. a kitchen sink is provided between an upper draw ring 23 and a lower blank holder ring 24. Under the lower blank holder ring 24 is provided a so-called shimming plate 1 (see FIG. 1) constituting a part of the tool according to the invention. The lower blank holder ring 24 contacts the shimming plate 1, and the upper draw ring 23 contacts the tool top part 16. The shimming plate 1 contacts the tool bottom part 17. A die 25 extends from a hydraulic cylinder 26 lowermost in the press, and the die 25 may be extended upward and downward in relation to the tool upper part 16. The die extends through apertures formed both in the tool bottom part 17, in the shimming plate 1 (see FIG. 1), in the lower blank holder ring 24, in the upper draw ring 23 and up in a cavity in the tool top part 16.

The shimming plate 1 is, as shown in FIG. 1, provided with chambers 2,3,4 of which only the chambers 2 (or chambers 3) are shown. The chambers are delimited downwards and laterally by the shimming plate 1, and are delimited upwards by a membrane 27 formed by a thin metal plate. The membrane 27 is attached at the edge of the chamber and has a thickness sufficiently small for the membrane being flexible when a pressure medium is led into the chamber 2. The pressure medium. preferably hydraulic oil, is led to the chamber through ducts 28 formed in the shimming plate 1. The ducts 28 have access for the pressure medium at an outer edge 29 of the shimming plate 1. Between a source of the pressure medium (not shown) and the inlet to the ducts in the shimming plate 1 there is fitted pressure amplifiers 30 in the shown embodiment of the tool. Alternatively, one or more of the pressure amplifiers may be omitted.

Figure 5:
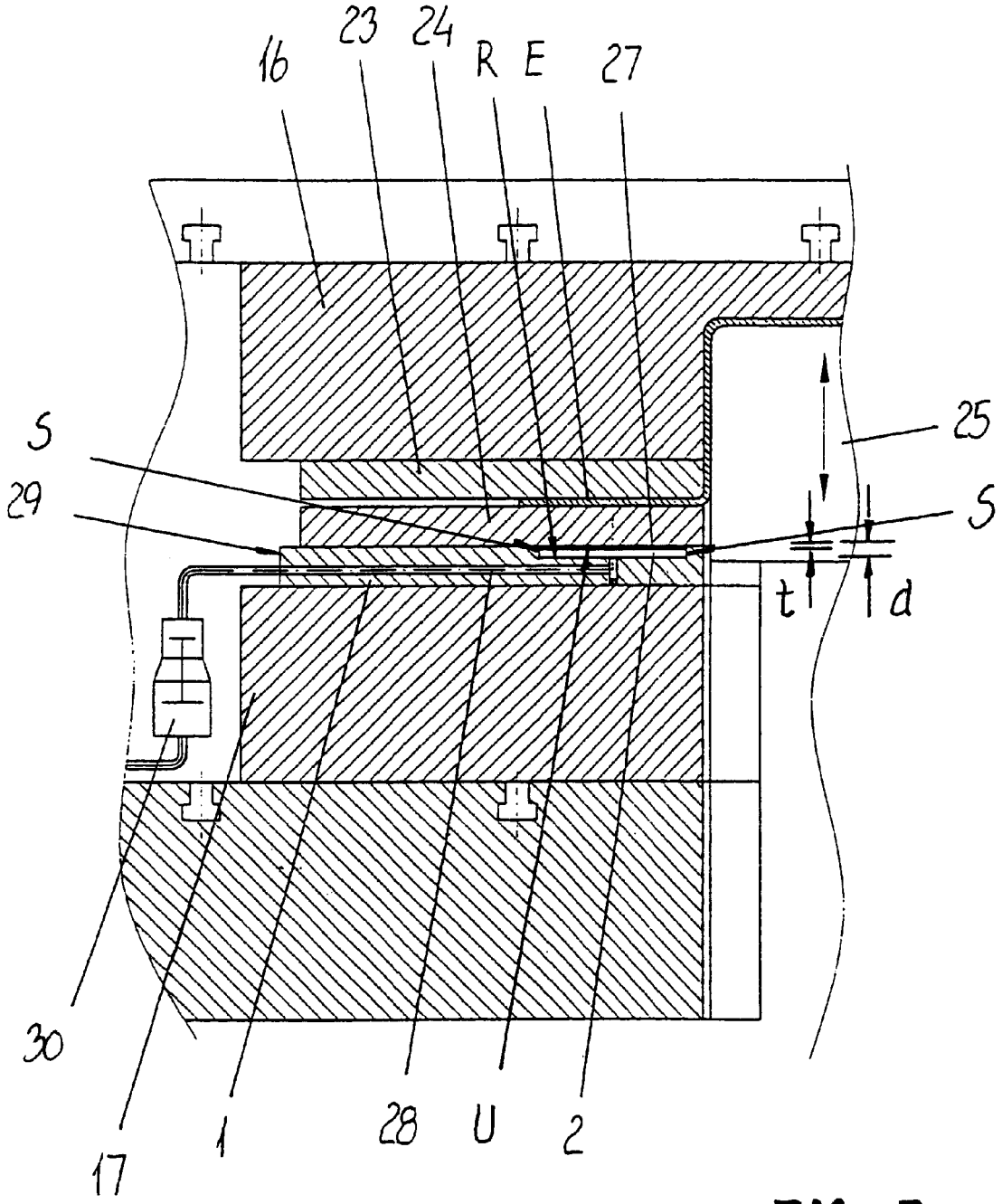
FIG. 5 is a section through a part of the possible embodiment of the tool according to the invention.

FIG. 5 is a section of FIG. 4. The section shows the shimming plate 1 with a chamber 2 formed around and in direction away from the die 25, with the membrane 27 attached to edges of the chamber, and with ducts 28 for conducting pressure medium to the chamber. The primary blank holder force between the upper draw ring 23 and the lower blank holder ring 24 is established by means of the thrust plane 19 and the tool top part 16. The shimming plate 1 is intended for increasing the blank holder force individually at given positions laterally around and in direction away from the die where the chambers are formed.

Due to the flexibility in the membrane, this is achieved by the pressure medium in the chamber pressing the membrane upwards against the blank and creating a further secondary surface pressure against the blank in addition to the primary pressure created by the thrust plane. As an alternative to the membrane creating an additional and increased surface pressure against the blank by means of the pressure medium, it is also possible to reduce the surface pressure on the blank as compared with the primary pressure from the thrust plane. This is established by reducing the pressure of the pressure medium in the chamber in order thereby to form a reduced surface pressure where the chambers are formed.

In the embodiment of a shimming plate 1 shown in FIG. 5, the chamber 2 is formed by a real milling in the shimming plate so that a chamber delimited by bottom R and sides S of the milling and by the under side U of the membrane 27 is formed. The milling has a depth d greater than the thickness t of the membrane so that the chamber 2 has a certain volume even in a situation where pressure medium is not supplied to the chamber.

However, the chamber 2 may also be formed in another way. If the depth d of the milling only has a size corresponding to the thickness t of the membrane, then no real chamber will be formed when pressure medium is not supplied to the cavity. The under side U of the membrane 27 will contact the bottom R of the milling in that situation. Only when pressure medium is supplied to the chamber 2, the chamber will obtain a real volume as the membrane 27 will then be displaced away from its contact with the bottom R of the milling. In connection with description and discussion of the present invention, the designation chamber will, however, be used even in the situation where the chamber does not have any real volume.

With the embodiment of the tool where the chamber 2 in the neutral position of the membrane 27 does not have any real volume, it will not be possible to reduce the pressure where the chambers are formed in relation to the pressure over the remaining part of the blank E between the blank holder ring 24 and the draw ring 23. A preferred method for making this embodiment consist in forming the milling in the shimming plate 1 and in a membrane 27 having a thickness t slightly greater than the depth d of the milling then being attached to the edge of the shimming plate 1. The upper side of the shimming plate 1 is then surface-ground.

Hereby is ensured that the upper side of the shimming plate 1 and the upper side of the membrane 27 lie in the same plane. In the case where pressure medium is not supplied to the chamber 2, and the chamber therefore does not have any real volume, then the surface pressure on the blank E to the shaped will be the same, either the pressure is between the upper side of the shimming plate 1 and the blank holder ring 24, alternatively the draw ring 23, or the pressure is between the upper side of the membrane 27 and the blank holder ring 24, alternatively the draw ring 23.

Thus it is possible to optimise the surface pressure on the blank during shaping. This is achieved by a combination of the selected shape and thereby the selected lateral and outward directed extension of each chamber and of the pressure in each single chamber. In the shimming plate it is possible to form individually situated chambers having individual shape depending on the item to be formed. Besides, during the shaping itself it is possible to regulate the pressure individually in each chamber so that the pressure is both regulated statically depending on the lateral and outward directed extension of the chamber concerned and dynamically depending on the shaping process itself, i.e. the pressure is regulated gradually as the die is pressing the blank to the finished item.

In a preferred embodiment as shown, pressure amplifiers are used for establishing sufficient pressure in the chambers for achieving a desired additional surface pressure against the blank. The pressure amplifier may e.g. have an supply pressure of up to 20 $N/mm^2$ and an discharge pressure of up to 50 $N/mm^2$. Preferably, the pressure amplifier works in the way that a given length of stroke of a piston (not shown) in the pressure amplifier results in supplying a given amount of pressure medium to the chambers.

Tables are provided below for a possible gradual pressure regulation of different chambers while a die is pressing a blank to a finished item. The finished item is a kitchen sink formed in a tool as shown in FIGS. 4 and 5 and with a shimming plate as shown in FIG. 1.

The starting item is a blank of stainless steel with a thickness of 0.9 mm. The shaping process is divided into steps, where step 1 is from the initial position of the die, and step 5 is toward the end position of the die. The position N,M of the die is the relative position of the die counted in inches and mm, respectively, from the initial position. Force F is the primary blank holder force established by the thrust plane. The speed v is the speed of the die in % of the possible maximum speed of the die on the hydraulic press in question.

Setting of Blank Holder Force on Thrust Plane

| | Position of Piston | | Force | Speed |
|---|---|---|---|---|
| | inch | mm | tons | % |
| Step 1 | N1 | M1 | F1 | v1 |
| Step 2 | N2 | M2 | F2 | v2 |
| Step 3 | N3 | M3 | F3 | v3 |
| Step 4 | N4 | M4 | F4 | v4 |
| Step 5 | N5 | M5 | F5 | v5 |

The shimming plate is divided into zones, where zone A comprises one of the chambers 2, zone B comprises the second of the chambers 2, zone C comprises both the chambers 3, and zone D comprises the chambers 4. It appears from the table below that a regulation of the pressure in each chamber and thereby in each zone occurs in the shaping process by regulating the pressure p individually in each zone and individually for each step.

Setting of Surface Pressure in Zones on Shimming Plate

| | Position of Piston | | Zone A | Zone B | Zone C | Zone D |
|---|---|---|---|---|---|---|
| | inch | mm | $N/mm^2$ | $N/mm^2$ | $N/mm^2$ | $N/mm^2$ |
| Step 1 | N1 | M1 | p1(A) | p1(A) | p1(A) | p1(A) |
| Step 2 | N2 | M2 | p2(A) | p2(B) | p2(C) | p2(D) |
| Step 3 | N3 | M3 | p3(A) | p3(B) | p3(C) | p3(D) |
| Step 4 | N4 | M4 | p4(A) | p4(B) | p4(C) | p4(D) |
| Step 5 | N5 | M5 | p5(A) | p5(B) | p5(C) | p5(D) |

The invention has been described above with reference to specific embodiments of a tool and with reference to different embodiments of shimming plates. It will be possible to make another tool structure for shaping other items or for changing the shaping process itself. It will also be possible to make other shimming plates for shaping other items that make different demands to the shape of the chambers, to the position of the chambers in the shimming plate and to the number of chambers extending laterally around as well as in direction away from the die.

What is claimed is:

1. A tool for pressure shaping of metal plate in a conventional hydraulic or mechanical press with at least one die, the tool comprising a shimming plate disposed between a tool part and pressing tools, wherein the shimming plate is provided with at least one chamber formed in the shimming plate on at least one side as seen in the direction of pressing and the chamber inwards is delimited by the shimming plate and the chamber outwards is delimited by a flexible membrane fastened to an edge area of the chamber, the at least one chamber is provided along a given length outward from the die and extending outward from and around the die, and wherein in the shimming plate there is formed access to the chamber for a fluid for creating a pressure in the chamber, and a metal plate to be shaped is placed between the further pressing tools, or between one of the further pressing tools and the shimming plate, wherein a division into several chambers is made in direction around the die, and the chambers are formed by millings in the shimming plate, a membrane is fastened to an edge of the milling such that an upper side of the membrane lies in the same plane as the surface of the shimming plate, and wherein the milling has a depth, and the membrane has a thickness less than or equal to the depth of the milling.

2. A tool according to claim 1, wherein for a number of given different first lengths extending outward from and corresponding other lengths extending laterally to the die, there are a corresponding number of chambers having a length extending outward from and laterally along the die.

3. A tool according to claim 1, wherein no chambers have been formed for a given number of second lengths extending outward from and corresponding second lengths extending laterally to the die, and that the corresponding number of chambers have been formed in given first lengths at each side of said second lengths.

4. A tool according to claim 1, wherein the at least one chamber is formed in the shimming plate at a side facing the further pressing tool, and that the metal plate to be shaped is placed between the further pressing tool and the side of the shimming plate at which the at least one chamber has been formed.

5. A tool according to claim 1, wherein the further pressing tool is a blank holder ring, or a draw ring, and that a tool part is a tool bottom part, alternatively a tool top part.

6. A tool according to claim 1, wherein ducts formed in the shimming plate extend between an inlet at an outer edge of the shimming plate and an outlet in the chambers in the shimming plate, and that pressure amplifiers are fitted between a pressure medium source and the inlet for ducts.

7. A tool according to claim 1, wherein the chambers are disposed in zones around the die, a number of first zones comprise chambers extending laterally along longitudinal sides of the die, a number of second zones comprise chambers extending along transverse sides of the die, and a number of third zones are situated between the first zones and the second zones and comprise chambers extending around sides of the die at transitions between the longitudinal sides and the transverse sides of the die.

8. A tool according to claim 1, wherein a volume of the chamber is delimited by sides and bottom of the milling and by an underside of the membrane.

9. A tool according to claim 1, wherein the chamber does not have any real volume when pressure medium has not been supplied to the chamber, and that a volume of the chamber is delimited by a bottom of the milling and of an underside of the membrane when pressure medium has been supplied to the chamber.

10. A method for regulating surface pressure on a blank in a pressing tool, the blank constituting a metal plate to be shaped by using a tool according to claim 1, wherein in a first step there is established a first pressure in a first zone between a draw ring and a blank holder ring and a second pressure in a number of chambers in a second zone, and that in a second, subsequent step there is established at least a second first pressure in the chambers in the first zone and optionally a second second pressure in the chambers in the second zone.

* * * * *